US007734220B2

(12) United States Patent
Oohara

(10) Patent No.: US 7,734,220 B2
(45) Date of Patent: Jun. 8, 2010

(54) VELOCITY CORRECTION DEVICE AND VELOCITY CORRECTION METHOD IN IMAGE FORMING APPARATUS

(75) Inventor: Shunichi Oohara, Hitachinaka (JP)

(73) Assignee: Ricoh Company, Ltd., Tokyo (JP)

( * ) Notice: Subject to any disclaimer, the term of this patent is extended or adjusted under 35 U.S.C. 154(b) by 193 days.

(21) Appl. No.: 11/874,540

(22) Filed: Oct. 18, 2007

(65) Prior Publication Data

US 2008/0107449 A1 May 8, 2008

(30) Foreign Application Priority Data

Oct. 19, 2006 (JP) ..... 2006-285060

(51) Int. Cl.
*G03G 15/00* (2006.01)

(52) U.S. Cl. ..... 399/167; 399/38; 399/75

(58) Field of Classification Search ..... 399/38, 399/75, 162, 167, 301, 302, 308, 394
See application file for complete search history.

(56) References Cited

U.S. PATENT DOCUMENTS 5,737,216 A 4/1998 Hokari
2005/0129427 A1 6/2005 Kinoshita et al.
2006/0184258 A1* 8/2006 Matsuda et al. ..... 700/56

FOREIGN PATENT DOCUMENTS

JP 05-252774 A 9/1993
JP 7-303385 A 11/1995
JP 2754582 B2 3/1998
JP 2005-176467 A 6/2005

* cited by examiner

*Primary Examiner*—David P Porta
*Assistant Examiner*—Benjamin Schmitt
(74) *Attorney, Agent, or Firm*—Crowell & Moring LLP

(57) ABSTRACT

A velocity correction device of an image forming apparatus capable of obtaining a high-quality image. The image forming apparatus includes a rotor, a motor, a motor control unit, and a velocity command memory. The velocity correction device includes a velocity measuring unit, an arithmetic unit, and an interface unit. The velocity correction device is attached to the image forming apparatus. The velocity measuring unit measures the rotational velocity of the rotor when the motor is rotating at a reference rotational velocity which is a fixed velocity. The arithmetic unit compares the measured velocity with a no-velocity-fluctuation velocity of the rotor calculated by the reference rotational velocity of the motor, extracts a velocity fluctuation component of the rotor, and generates the velocity command data to cancel the extracted velocity fluctuation component. The generated velocity command data are transmitted to the velocity command memory through the interface unit, and stored therein.

20 Claims, 5 Drawing Sheets

VELOCITY CORRECTION DEVICE AND VELOCITY CORRECTION METHOD IN IMAGE FORMING APPARATUS

FIELD OF THE INVENTION

The present invention relates to a velocity correction device and a velocity correction method in an image forming apparatus using an electrophotographic system, and particularly relates to a technique for reducing banding caused by eccentricity, deformation, etc. of reduction gears in an image forming apparatus.

BACKGROUND OF THE INVENTION

The following Patent Document 1 discloses a method in which a rotor driving motor is rotated in a constant velocity in advance, information of rotational velocity fluctuation of a driving shaft at that time is stored in a storage means, and the information of the rotational velocity fluctuation (change) is read from the storage means so as to change the velocity of the driving motor.

Patent Document 1: Japanese Patent No. 2,754,582

There is an image forming apparatus using an electrophotographic system, as follows. That is, an electrostatic latent image is formed on a photoconductor by laser scanning, and toner is applied to the electrostatic latent image by a developing means. A toner image formed thus is transferred to an intermediate transfer belt by a first transfer means. Next the toner image is transferred from the intermediate transfer belt to paper by a second transfer means.

The image forming apparatus generally uses a motor and a reducer for rotating and conveying a driving roller for a photoconductor drum or a photoconductor belt, a driving roller for the intermediate transfer belt, etc.

Gears are chiefly used as the reducer in view of cost. Due to eccentricities of the gears, single pitch errors and cumulative pitch errors of gear teeth, etc., rotational fluctuation appears in the output shaft of the reducer in spite of constant-velocity rotation of the motor. The rotational fluctuation leads to image unevenness on the photoconductor or the intermediate transfer belt. Thus, the image quality deteriorates.

In the background art, there has been proposed a method in which rotational fluctuation is detected by an encoder attached to a transfer drum shaft, and a motor is controlled to cancel the detected rotational fluctuation.

However, in order to detect the rotational fluctuation of a reducer accurately up to a high frequency, a high-precision encoder is required. Thus, the apparatus cost increases. When a low-price encoder is used, only a comparatively low frequency component corresponding to one turn of a photoconductor, a photoconductor driving roller or an intermediate transfer driving roller can be corrected.

SUMMARY OF THE INVENTION

An object of the present invention is to provide a velocity correction device and a velocity control method in an image forming apparatus by which a high-quality image with no image disarrangement can be obtained.

In order to attain the foregoing object, a first configuration of the present invention provides a velocity correction device in an image forming apparatus including a rotor, a motor for driving the rotor, a motor control unit for controlling an operation of the motor, and a velocity command memory for storing velocity command data and supplying the motor control unit with a command signal based on the velocity command data.

The velocity correction device includes a velocity measuring unit for measuring a rotational velocity or a peripheral velocity of the rotor, an arithmetic unit, and an interface unit for supplying the velocity command data to the velocity command memory of the image forming apparatus.

The first configuration is characterized as follows.

That is, the velocity correction device is removably attached to the image forming apparatus. In this state:

the velocity measuring unit measures the rotational velocity or the peripheral velocity of the rotor when the motor is rotating at a reference rotational velocity which is a fixed velocity;

the arithmetic unit compares the measured velocity with a no-velocity-fluctuation velocity of the rotor calculated by the reference rotational velocity of the motor, extracts a velocity fluctuation component of the rotor, and generates the velocity command data to cancel the extracted velocity fluctuation component; and the generated velocity command data are transmitted to the velocity command memory through the interface unit, and stored in the velocity command memory.

A second configuration of the present invention is based on the first configuration. The second configuration is characterized in that the rotor includes at least one of a photoconductor drum, a photoconductor belt, a gear of a reducer for reducing a driving force from the motor, an intermediate transfer belt, and a roller for driving the photoconductor belt or the intermediate transfer belt.

A third configuration of the present invention is based on the first configuration. The third configuration is characterized in that the arithmetic unit includes a band pass filter for extracting a fluctuation frequency which periodically appears due to rotation of the rotor and affects quality of an image formed by the image forming apparatus.

A fourth configuration of the present invention is based on the first or second configuration. The fourth configuration is characterized in that a one-turn sensor for detecting one turn of the rotor or the motor is provided, and the arithmetic unit generates the velocity command data corresponding to the one turn of the rotor or the motor based on a detection signal of the one-turn sensor.

A fifth configuration of the present invention is based on the fourth configuration. The fifth configuration is characterized in that time of the one turn detected by the one-turn sensor is divided into a plurality of split times, and the velocity command data are stored in the velocity command memory every split time.

A sixth configuration of the present invention is based on any one of the first, fourth and fifth configurations. The sixth configuration is characterized in that a reduction gear is provided between the motor and the rotor which will be measured by the velocity measuring unit, and a ratio of a rotation frequency with which the rotor rotates to a rotation frequency with which the reduction gear rotates is expressed by an integer.

A seventh configuration of the present invention provides a velocity correction method in an image forming apparatus including a rotor, a motor for driving the rotor, a motor control unit for controlling an operation of the motor, a velocity command memory for storing velocity command data and supplying the motor control unit with a command signal based on the velocity command data, and a velocity correction device.

The velocity correction device includes a velocity measuring unit for measuring a rotational velocity or a peripheral velocity of the rotor, an arithmetic unit, and an interface unit for supplying the velocity command data to the velocity command memory of the image forming apparatus.

The seventh configuration is characterized by including the steps of:

removably attaching the velocity correction device to the image forming apparatus;

making the motor rotate at a reference rotational velocity which is a fixed velocity, making the velocity measuring unit measure the rotational velocity or the peripheral velocity of the rotor when the motor is rotating at the reference rotational velocity, and supplying the measured velocity to the arithmetic unit;

making the arithmetic unit compare the measured velocity with a no-velocity-fluctuation velocity of the rotor calculated by the reference rotational velocity of the motor, extract a velocity fluctuation component of the rotor, and generate the velocity command data to cancel the extracted velocity fluctuation component;

transmitting the generated velocity command data to the velocity command memory through the interface unit so as to make the velocity command memory store the velocity command data;

removing the velocity correction unit from the image forming apparatus after storing the velocity command data; and reading the stored velocity command data from the velocity command memory and supplying the velocity command data to the motor control unit.

An eighth configuration of the present invention is based on the seventh configuration. The eighth configuration is characterized in that the rotor includes at least one of a photoconductor drum, a photoconductor belt, a gear of a reducer for reducing a driving force from the motor, an intermediate transfer belt, and a roller for driving the photoconductor belt or the intermediate transfer belt.

A ninth configuration of the present invention is based on the seventh configuration. The ninth configuration is characterized in that the arithmetic unit includes a band pass filter for extracting a fluctuation frequency which periodically appears due to rotation of the rotor and affects quality of an image formed by the image forming apparatus.

A tenth configuration of the present invention is based on the seventh or eighth configuration. The tenth configuration is characterized in that a one-turn sensor for detecting one turn of the rotor or the motor is provided, and the arithmetic unit generates the velocity command data corresponding to the one turn of the rotor or the motor based on a detection signal of the one-turn sensor.

An eleventh configuration of the present invention is based on the seventh or tenth configuration. The eleventh configuration is characterized in that time of the one turn detected by the one-turn sensor is divided into a plurality of split times, and the velocity command data are stored in the velocity command memory every split time.

A twelfth configuration of the present invention is based on any one of the seventh, tenth and eleventh configurations. The twelfth configuration is characterized in that a reduction gear is provided between the motor and the rotor which will be measured by the velocity measuring unit, and a ratio of a rotation frequency with which the rotor rotates to a rotation frequency with which the reduction gear rotates is expressed by an integer.

According to any configuration of the present invention described above, it is possible to provide a velocity correction device or a velocity correction method in an image forming apparatus in which a high-quality image with no image disarrangement can be obtained.

DETAILED DESCRIPTION OF THE EMBODIMENTS

Figure 1:
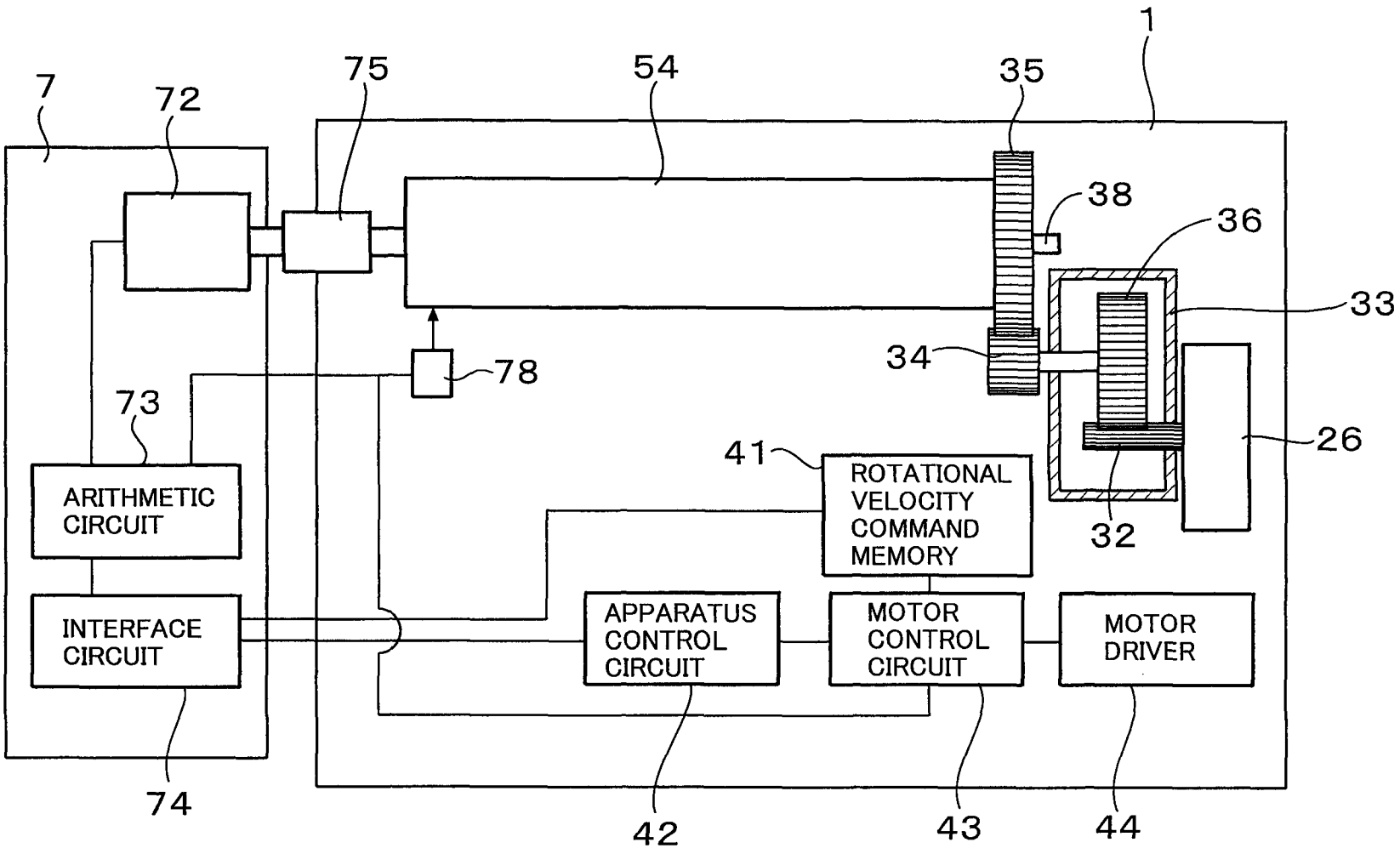
FIG. 1 is a schematic configuration diagram of a photoconductor driving unit and a velocity correction device in an image forming apparatus according to a first embodiment of the present invention.

Embodiments of the present invention will be described below with reference to the drawings. FIG. 1 is a schematic configuration diagram of a photoconductor driving unit and a velocity correction device in an image forming apparatus according to a first embodiment of the present invention.

An apparatus control circuit 42 of an image forming apparatus 1 controls various operations of the apparatus including not only a motor 26 for driving a photoconductor drum 54 but also not-shown other motors and so on.

The photoconductor driving unit is constituted by the motor 26, a motor gear 32, a gear A 36 serving as a reducer, a gear B 34 rotating coaxially with the gear A 36, a gear box 33, and so on. The photoconductor drum 54 is attached to a photoconductor shaft 38, and driven with a junction gear 35 by the photoconductor driving unit.

A one-turn sensor 78 for detecting one turn of the photoconductor drum 54 is, for example, an optical sensor constituted by a pair of a light emitting element and a light receiving element. Reflected light of light emitted from the light emitting element is received by the light receiving element. The light receiving element outputs an ON/OFF signal in accordance with the amount of the received light. In order to detect one turn of the photoconductor drum 54, a marker is provided in the surface of a non-image forming area which is an end portion of the photoconductor drum 54. The marker is, for example, a matte black marker which can suppress reflection of light. There appears a change in the amount of reflected light when the marker goes under the one-turn sensor 78 with the rotation of the photoconductor drum 54. If the change is detected, one turn of the photoconductor drum 54 can be detected.

A motor control circuit 43 controls the motor 26 to rotate the motor 26 in accordance with the velocity command data stored in a rotation velocity command memory 41 serving as a storage means. A motor driver 44 supplies a motor driving voltage pulse to the motor 26 in accordance with a signal outputted by the motor control circuit 43. For example, a DC brushless motor or a stepping motor is used as the motor 26.

A velocity correction device 7 includes a photoconductor shaft coupling 75 connected to the photoconductor shaft 38 of the image forming apparatus 1, an encoder 72 connected thereto, an arithmetic circuit 73, and an interface circuit 74. The parts of the velocity correction device 7 are connected to one another as shown in FIG. 1.

FIG. 2A-2D show an example of rotational velocity fluctuation in the photoconductor driving unit. In FIGS. 2A-2D, the abscissa designates time, and the ordinate designates fluctuation. By way of example, the rotation frequency of the photoconductor drum 54 was set as 3 Hz, the rotation frequencies of the gear A 36 and the gear B 34 serving as reduction gears were set as 9 Hz, and the rotation frequency of the motor 26 was set as 27 Hz.

Figure 2A:
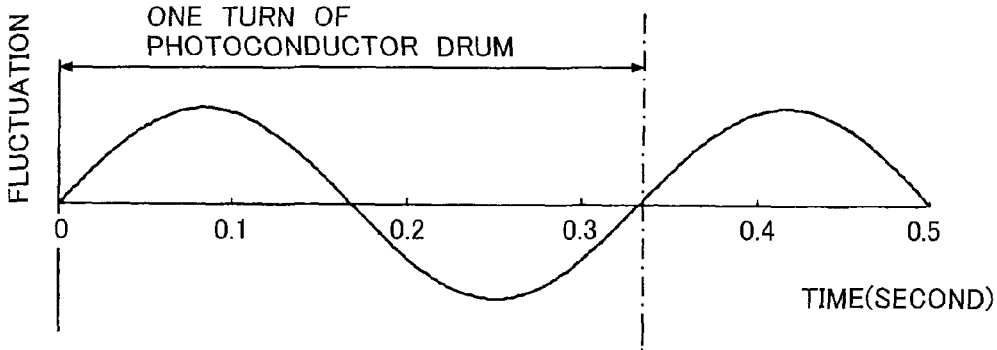
FIGS. 2A-2D are waveform charts showing an example of rotational velocity fluctuation of the photoconductor driving unit.
Figure 2B:
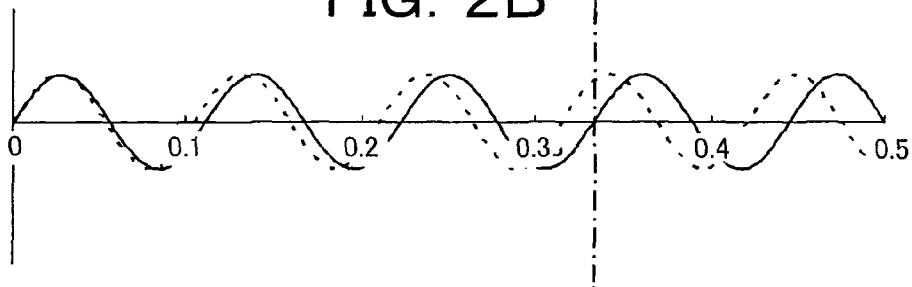
Figure 2C:
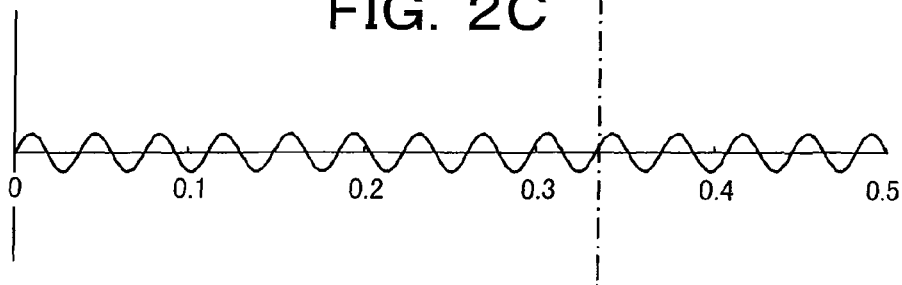
Figure 2D:
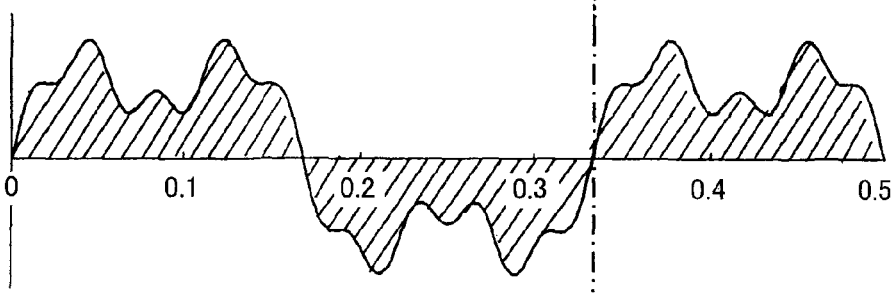

Chiefly due to the mounting eccentricity of the joint gear 35 to the photoconductor shaft 38 and so on, the rotation frequency of the photoconductor drum 54 has a fluctuation component as shown in FIG. 2A. The eccentricities of the gear A 36 and the gear B 34 lead to periodical rotational fluctuation as shown in FIG. 2B. The eccentricity of the motor gear 32 rotating integrally with the motor 26 leads to periodical rotational fluctuation as shown in FIG. 2C. Rotational fluctuation appearing in the photoconductor shaft 38 has a waveform where these fluctuation components are combined. As a result, the rotation frequency of the photoconductor shaft 38 has a periodical fluctuation as shown in FIG. 2D.

Next, the operations of the photoconductor driving unit and the velocity correction device according to this embodiment will be described.

After the image forming apparatus 1 is assembled in a manufacturing line, the velocity correction device 7 is connected to the photoconductor shaft 38 through the coupling 75. With this connection, the interface circuit 74 of the velocity correction device 7 is connected to the rotational velocity memory 41 and the apparatus control circuit 42 of the image forming apparatus 1 as shown in FIG. 1. In addition, the one-turn sensor 78 of the image forming apparatus 1 is connected to the arithmetic circuit 73 of the velocity correction device 7.

In response to a command from a command switch (not shown) of the velocity correction device 7 or the like, the motor 26 is rotated at a constant reference rotational velocity by the apparatus control circuit 42. The rotational force of the motor 26 is transferred to the photoconductor shaft 38 through the motor gear 32, the gear A 36, the gear B 34, the joint gear 35 and the photoconductor drum 54. The rotational velocity of the photoconductor shaft 38 is measured by the encoder 72 of the velocity correction device 7. The measured velocity includes velocity fluctuation caused by eccentricities of the motor 26 and the parts following the motor 26, that is, the motor gear 32, the gear A 36, the gear B 34, the joint gear 35, the photoconductor drum 54 and the photoconductor shaft 38, and so on.

The measured velocity is supplied to the arithmetic circuit 73. In the arithmetic circuit 73, the measured velocity is compared with an ideal rotational velocity (constant rotational velocity which has no velocity fluctuation and which is, for example, expressed by a straight line corresponding to the abscissa in FIG. 2D) of the photoconductor shaft 38 calculated by the reference rotational velocity of the motor 26 itself, and a difference between the measured velocity and the ideal velocity is obtained. Based on the difference, the arithmetic circuit 73 extracts a rotational fluctuation component of the photoconductor drum 54 corresponding to the hatched portion in FIG. 2D.

Further the arithmetic circuit 73 extracts a fluctuation frequency of a required band by use of a band pass filter, and generates motor rotational velocity command data which will cancel the rotational velocity fluctuation of the photoconductor drum 54.

For example, of the rotation frequency of the photoconductor drum 54, a frequency component not higher than 3 Hz is not caused by the driving system in principle, and the frequency component may have no periodicity. If the frequency component not higher than 3 Hz is used for correction, the rotational velocity fluctuation of the photoconductor drum 54 may increase. In fact there is a fluctuation not lower than several hundreds of Hz. However, it is difficult to recognize such a fluctuation visually on any image. The fluctuation counts for nothing, but may cause an error in correction.

A rotation frequency component of the photoconductor drum 54, a rotation frequency component of the motor 26 and rotation frequency components of the gear A 36 and the gear B 34 may affect any image visually. In order to reduce those frequency components, the aforementioned band pass filter is used to remove a frequency component not higher than 3 Hz and a high frequency component not lower than several hundreds of Hz.

The motor rotational velocity command data outputted from the arithmetic circuit 73 are supplied to the rotational velocity command memory 41 of the image forming apparatus 1 through the interface circuit 74, and stored therein. The motor rotational velocity command data are, for example, pulse frequency data for driving the motor.

Time of one turn of the photoconductor drum 54 (one-turn time) is divided into a plurality of integral split times. The motor rotational velocity command data (pulse frequency data) are assigned to each region of the memory every split time. The more the number of the split times is, the more accurately the velocity correction can be performed. During the rotation of the motor 26, the motor control circuit 43 reads the pulse frequency data from the rotational velocity command memory 41 sequentially in accordance with a control clock signal outputted from the apparatus control circuit 42, and sets the read pulse frequency data as a command signal to make the motor driver 44 rotate the motor 26.

To use the one-turn time of the photoconductor drum 54, a one-turn sensor 78 for detecting one turn of the photoconductor drum 54 is provided to measure rotational velocity fluctuation accurately in a period corresponding to the detected one turn. When periodical fluctuation is extracted by the band pass filter of the arithmetic circuit 73, a start point of data corresponds to an end point of the data. The motor rotational velocity command data (pulse frequency data) corresponding to the one turn based on the data is used repeatedly. Thus, continuous rotation can be performed. When rotational velocity fluctuation corresponding to one turn is measured several times to generate averaged motor rotational velocity command data (pulse frequency data), the fluctuation can be reduced more accurately.

Alternatively, one turn of the gear B 34 or the motor 26 may be detected. Also in this case, time of the detected one turn is divided into integral split times, and pulse frequency data are assigned to the memory every split time.

The rotation frequency component of the motor 26 has a greater fluctuation than that of any other factor. Only if correction is performed with respect to this frequency component, great effect to reduce banding can be obtained. In this case, the capacity of the rotational velocity command memory 41 can be reduced, and the time the velocity correction device 7 must measure can be also reduced. There is a great effect to reduce the cost.

Desirably an integral ratio is established between the rotation frequency with which each of the motor 26, the gear A 36, the gear B 34 and the joint gear 35 rotates and the rotation frequency with which the photoconductor drum 54 rotates. When the integral ratio is established, rotational fluctuation including the motor 26, the gear A 36 and the gear B 34 can be recorded accurately only in the time of one turn of the joint gear 35, that is, one turn of the photoconductor drum 54.

For example, when the rotation frequency of the gear A 36 and the gear B 34 does not produce an integral ratio but is 9.5 Hz, the rotational velocity fluctuation is shown by the broken line in FIG. 2B. The fluctuation is not 0 at the time of the chain line which is the time of one turn of the photoconductor drum 54. That is, a start point of a fluctuation component of measured data does not correspond to an end point thereof. Therefore, correction based on such data produces an error such that the fluctuation component cannot be reduced.

In order to eliminate such an error in such a frequency ratio, the photoconductor drum 54 has to be rotated to extract a rotational fluctuation component till an integral rotation frequency ratio can be established among the gears. When the rotation frequency of the photoconductor drum 54 is 3 Hz and the rotation frequency of the gear A 36 and the gear B 34 is 9 Hz, each of the gear A 36 and the gear B 34 has three turns in the period of one turn of the photoconductor drum 54. Due to the integral ratio (1:3 in this embodiment), it will go well if the photoconductor drum 54 is rotated by only one turn.

However, if the rotation frequency of the photoconductor drum 54 is 3 Hz and the rotation frequency of the gear A 36 and the gear B 34 is 9.5 Hz as described previously, the photoconductor drum 54 must have six turns in order that each of the gear A 36 and the gear B 34 has an integral number of turns. Therefore, unpreferably the memory capacity required for accumulating the pulse frequency data increases and the time of measuring by the velocity correction device 7 also increases.

After corrected motor rotational velocity commands are stored in the rotational velocity command memory 41, the velocity correction device 7 is removed from the image forming apparatus 1. The image forming apparatus 1 without the velocity correction device 7 is shipped out as a product.

During the operation of the image forming apparatus 1, the motor control circuit 43 outputs the motor rotational velocity command data stored in the rotational velocity command memory 41 while adapting (synchronizing) a start point of the motor rotational velocity command data in accordance with a detection signal of the one-turn sensor 78. When the motor 26 is rotated in this manner, it is possible to reduce the rotational fluctuation caused by eccentricities, single pitch errors, cumulative pitch errors, etc. of the motor gear 32, the gear A 36, the gear B 34, and the joint gear 35 attached to the photoconductor shaft 38.

The velocity correction device 7 can deal with a large number of image forming apparatus 1 mass-produced sequentially. As a result, a high-resolution encoder can be used as a measuring means. Therefore, precise correction can be performed so that the velocity fluctuation of the photoconductor drum 54 can be suppressed. Thus, a high-quality image with reduced banding can be obtained.

In addition, an encoder for correcting the rotational velocity of the photoconductor drum does not have to be provided on the image forming apparatus 1 side. It is also possible to miniaturize the apparatus and reduce the cost.

Description will be made below about the arrangement where the photoconductor drum 54, the joint gear 35 and the photoconductor shaft 38 are integrated as a unit in this embodiment.

When the unit can be removably mounted in a body of the image forming apparatus 1, fluctuation caused by the eccentricities of the photoconductor drum 54, the joint gear 35 and the photoconductor shaft 38 and the accuracies of gears such as the single pitch error and the cumulative pitch error of the joint gear 35, etc. can be changed by the replacement of the unit.

When the motor rotational velocity command data are stored in the rotational velocity command memory 41 by the arithmetic circuit 73 without removing rotational velocity fluctuation components changed by the replacement of the unit, accurate correction cannot be performed after the replacement. These components may be doubled in some characteristic of the unit.

Therefore, a band pass filter is used in the arithmetic circuit 73. The band pass filter has a function to remove a frequency component not higher than the rotation frequency of the photoconductor drum 54 which is replaceable, and to remove a frequency not lower than the meshing frequency component of the joint gear 35. Thus, the motor rotational velocity command data are generated and outputted. As a result, the velocity fluctuation can be prevented from increasing due to the replacement of the unit. Even if the photoconductor drum 54 is replaced, it is possible to keep the effect to reduce the rotational velocity fluctuation caused by the eccentric components of the motor and the other gears.

Figure 3:
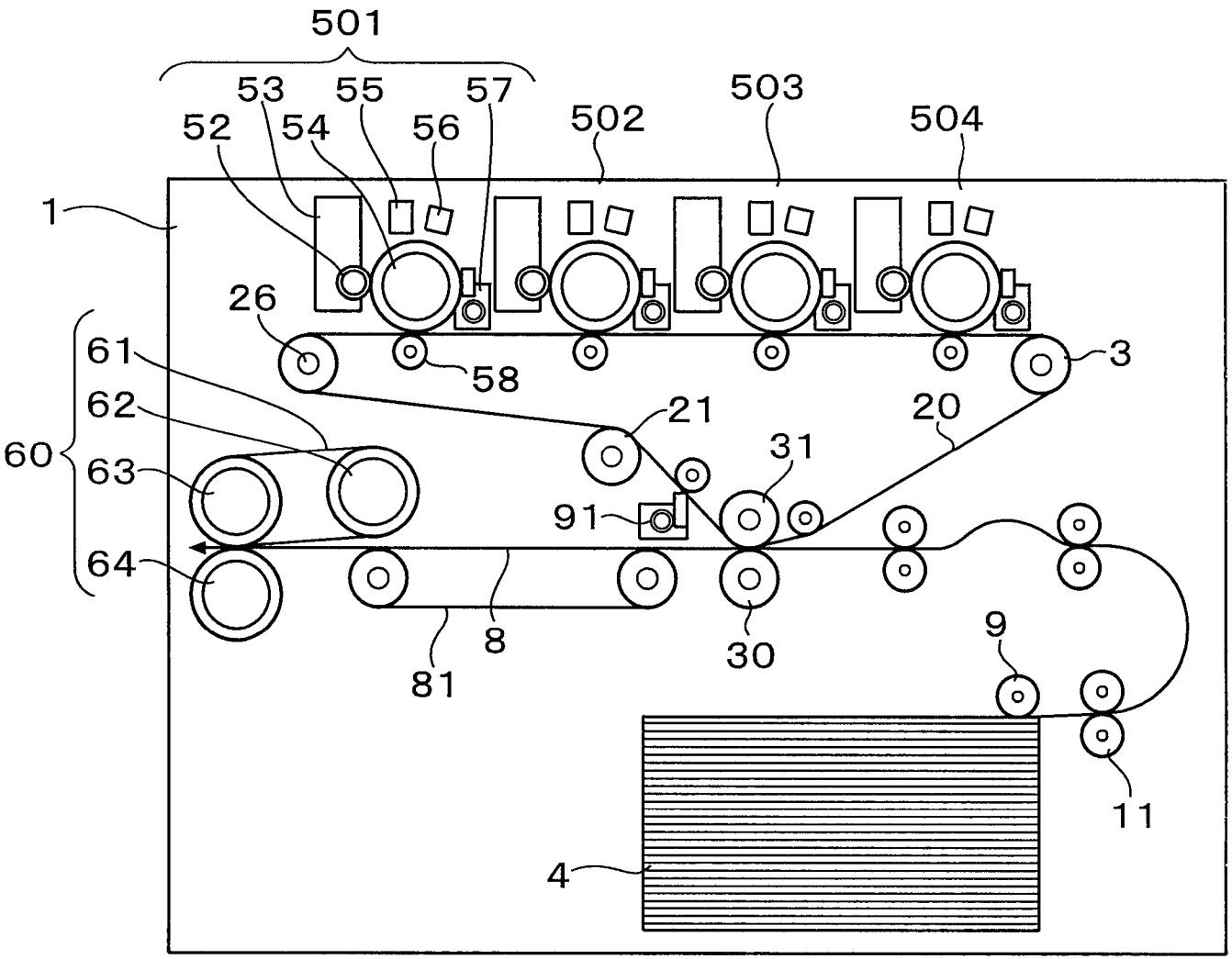
FIG. 3 is a schematic configuration diagram of the whole of the image forming apparatus according to the embodiment of the present invention.

FIG. 3 is a schematic configuration diagram of the whole of the image forming apparatus according to the embodiment of the present invention.

In the image forming apparatus 1, developing units 501 to 504 of respective colors are disposed on an intermediate transfer belt 20 so as to form toner color images with toners on the intermediate transfer belt 20. The toner color images are transferred onto paper conveyed from a paper stack unit 4. The toners are melted and fixed by heat and pressure in a fixing unit 60. Thus, a color image is formed.

The four developing units 501 to 504 include a K developing unit 501 with black toner, a C developing unit 502 with cyan toner, an M developing unit 503 with magenta toner, and a Y developing unit 504 with yellow toner.

Each developing unit 501-504 is constituted by a toner hopper 53 for storing toner, a developing roller 52 for forming a layer of the toner and bringing the toner into contact with the photoconductor drum 54, a drum cleaner 57 for cleaning the surface of the photoconductor drum 54, a charger 55 for charging the surface of the photoconductor drum 54, and an exposing unit 56 for writing an electrostatic latent image on the photoconductor drum 54.

The photoconductor drum 54 of each color includes a motor 26, a motor control circuit 43, a motor driver 44, a rotational velocity command memory 41, a motor gear 32, a gear A 36 serving as a reducer, a gear B 34 rotating coaxially with the gear A 36, and a gear box 33. The photoconductor drum 54 is driven and rotated with the gear B 34 and a joint gear 35.

The velocity correction device 7 is attached to the photoconductor drum 54. Motor rotational velocity command data for reducing the rotational velocity fluctuation of the photoconductor drum 54 is stored in the rotational velocity command memory 41.

The intermediate transfer belt 20 is laid among a plurality of rollers, and conveyed by a second driving roller 3. A belt cleaner 91 removes residual toner from the surface of the intermediate transfer belt 20. A primary transfer roller 58 is disposed inside the intermediate transfer belt 20 so as to face the photoconductor drum 54.

A paper conveyance path 8 runs from the paper stack unit 4 where pieces of paper have been stacked. Via a pickup roller 9 and separation rollers 11, the paper conveyance path 8 passes between a secondary transfer roller 30 and the intermediate transfer belt 20, and reaches the fixing unit 60 through a conveyance belt 81.

The fixing unit 60 includes a backup roller 64, an elastic roller 63, a heating roller 62 and a fixing belt 61. The fixing belt 61 is laid between the elastic roller 63 and the heating roller 62, and conveyed by the rotation of the heating roller 62 or another roller. The paper is pressed onto the elastic roller 63 side by the backup roller 64. The heating roller 62 has a heating means such as a halogen heater or the like in a hollow shaft made of metal so as to heat the fixing belt 61. The surface of the elastic roller 63 is formed out of an elastic material such as silicon rubber. As pressed by the backup roller 64, a nip portion is made convex on the elastic roller 63 side so as to prevent the paper from being wound on the fixing belt 61.

To form an image, the surface of the photoconductor drum 54 is charged by the charger 56 and irradiated with light in accordance with the image by the exposing unit 55 so that the potential on the photoconductor drum 54 is dropped down. When the exposed portion arrives at the developing roller 52 due to the rotation of the photoconductor drum 52 and comes into contact with a toner layer, charged toner adheres to an image position.

A toner image formed on the photoconductor drum 54 in such a manner is transferred onto the intermediate transfer belt 20 in a portion where the primary transfer roller 58 presses the intermediate transfer belt 20.

Toner images on the photoconductor drums 54 of the developing units 501 to 504 are transferred onto the intermediate transfer belt 20 so as to form color toner images. Due to the conveyance of the intermediate transfer belt 20, the toner images are transferred onto the conveyed paper in the portion of the secondary transfer roller 30. The paper where the toner images have been transferred is conveyed to the fixing unit 60 by the conveyance belt 81, and the toners are melted and fixed by heat and pressure. Thus, a color image is formed.

In this embodiment, the rotational velocity of the photoconductor drum 54 can be performed precisely by use of the velocity correction device 7 having a high-resolution encoder as a measuring means. Thus, the rotational velocity fluctuation of the photoconductor drum 54 is suppressed so that a high-quality image with reduced banding can be obtained.

Four sets of driving means are disposed for the photoconductor drums 54 respectively in this embodiment. However, even when one motor 26 is used to drive a plurality (four in this embodiment) of photoconductor drums 54 with a gear train, an effect to reduce the rotational velocity fluctuation of the photoconductor drum 54 can be obtained in the same manner. In this configuration, the number of motors 26 is reduced. Thus, the apparatus can be made smaller, and the cost can be made lower.

Figure 4:
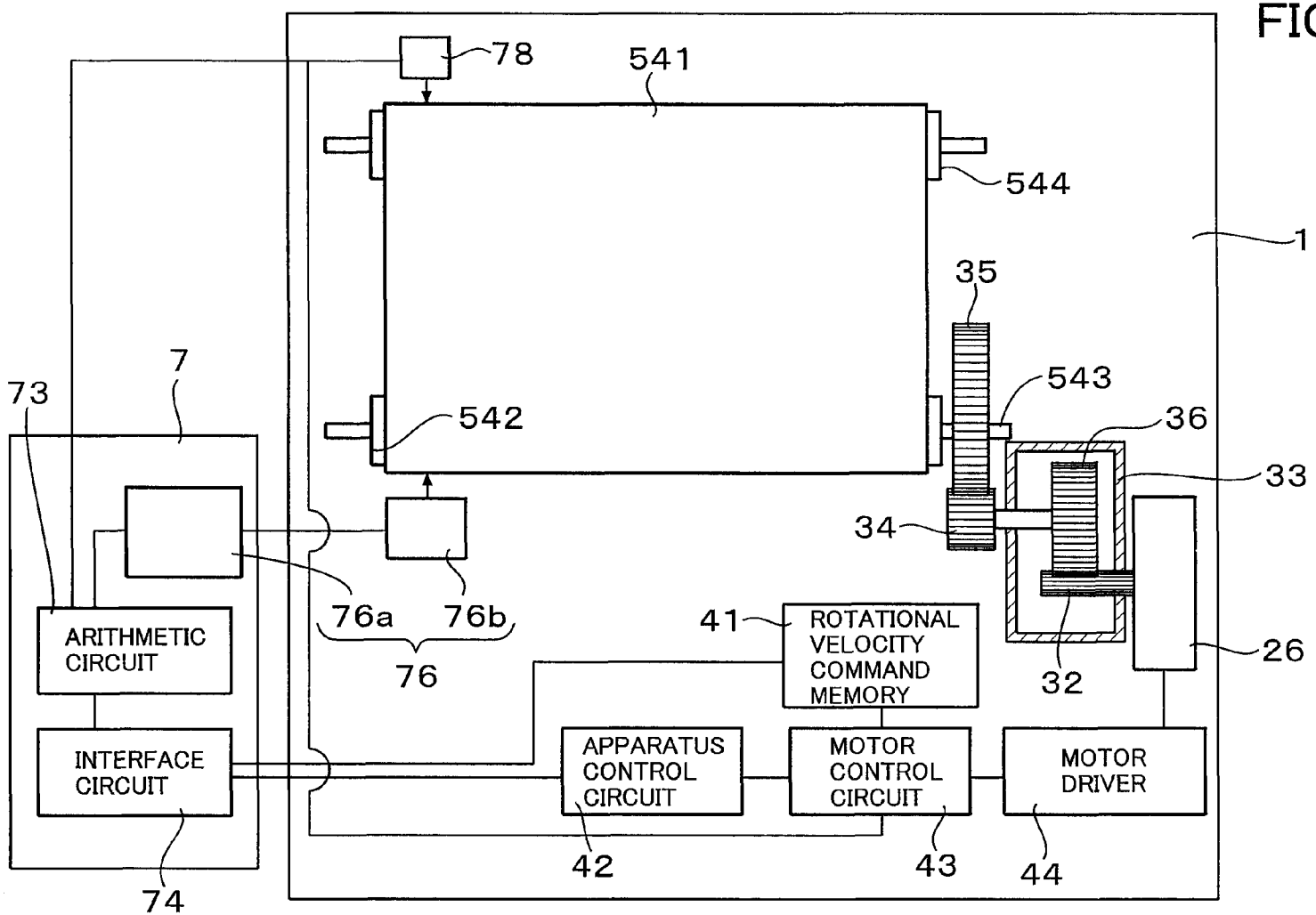
FIG. 4 is a schematic configuration diagram of a photoconductor driving unit and a velocity correction device in an image forming apparatus according to a second embodiment of the present invention.

FIG. 4 is a schematic configuration diagram for explaining a photoconductor driving unit of an image forming apparatus and a velocity correction device according to a second embodiment of the present invention.

The second embodiment is different from the first embodiment at the point that the photoconductor drums are replaced by a photoconductor belt 541. The photoconductor belt 541 is laid between a driving roller 542 and a driven roller 544. The driving roller 542 is attached to a driving roller shaft 543, and driven with a joint gear 35 by a photoconductor driving unit.

A velocity correction device 7 according to this embodiment is designed so that a laser Doppler velocimeter 76 is used in place of the encoder 72 and the photoconductor shaft coupling 75 so as to measure the velocity fluctuation of the photoconductor belt 541 directly. The laser Doppler velocimeter 76 is a non-contact, small-sized and high-precision velocimeter using a diffraction laser light Doppler system. The laser Doppler velocimeter 76 is constituted by a velocimeter body 76*a* and a sensing terminal 76*b*. The sensing terminal 76*b* faces the photoconductor belt 541 which is a subject to be sensed.

The output of the laser Doppler velocimeter 76 is processed into motor rotational velocity command data by the arithmetic circuit 73 in the same manner as in the first embodiment. The motor rotational velocity command data are supplied to the rotational velocity memory 41 through the interface circuit 74 and stored therein.

The velocity correction device 7 is attached to an image forming apparatus 1 in a manufacturing line or the like. Motor rotational velocity command data are stored in the rotational velocity command memory 41 of the image forming apparatus 1. After the data are stored, the velocity correction device 7 is removed from the image forming apparatus 1, and attached to another next image forming apparatus 1.

The image forming apparatus 1 rotates the motor 26 based on the stored motor rotational velocity command data. Thus, it is possible to reduce the rotational fluctuation caused by eccentricities, single pitch errors, cumulative pitch errors, etc. of the motor gear 32, the gear A 36, the gear B 34, and the joint gear 35 attached to the photoconductor shaft 38.

An encoder for correcting the photoconductor velocity does not have to be provided in the image forming apparatus body. It is therefore possible to miniaturize the apparatus and reduce the cost.

Similar correction can be performed when the encoder 72 is used in the same manner as in the first embodiment. However, when the laser Doppler velocimeter 76 is used, the conveyance velocity of the photoconductor belt 541 can be measured directly.

In order to drive the photoconductor belt 541 stably, a portion of the driving roller 542 which will be in contact with the photoconductor belt 541 is made of a rubber material having a high coefficient of friction. In that case, the eccentricity of the driving roller 542 is higher than that of a metal roller, and the roundness is also lowered. Thus, the conveyance velocity fluctuation increases.

This fluctuation cannot be measured even if an encoder is connected to the shaft of the driving roller. However, the fluctuation can be measured if the surface of the photoconductor belt 541 is measured directly by the laser Doppler velocimeter 76. As a result, the conveyance velocity fluctuation can be made lower than that when an encoder is used.

In this embodiment, the photoconductor belt 541 may be replaced by the intermediate transfer belt 20. In this case, the driving roller 542 is set as the second driving roller 3, and the velocity correction device 7 is used as a velocity correction device for the intermediate transfer belt. Thus, the conveyance velocity fluctuation of the intermediate transfer belt 20 can be reduced.

This embodiment may be combined with the first embodiment. In this manner, the rotational fluctuation of the photoconductor drum 54 can be reduced, and the conveyance velocity fluctuation of the intermediate transfer belt 20 can be also reduced. Thus, a higher-quality image can be obtained.

In the aforementioned embodiment, the conveyance velocity of the photoconductor belt 541 or the intermediate transfer belt 20 was measured. The rotational velocity of a driving roller or a driven roller for rotating these belts may be measured.

Figure 5:
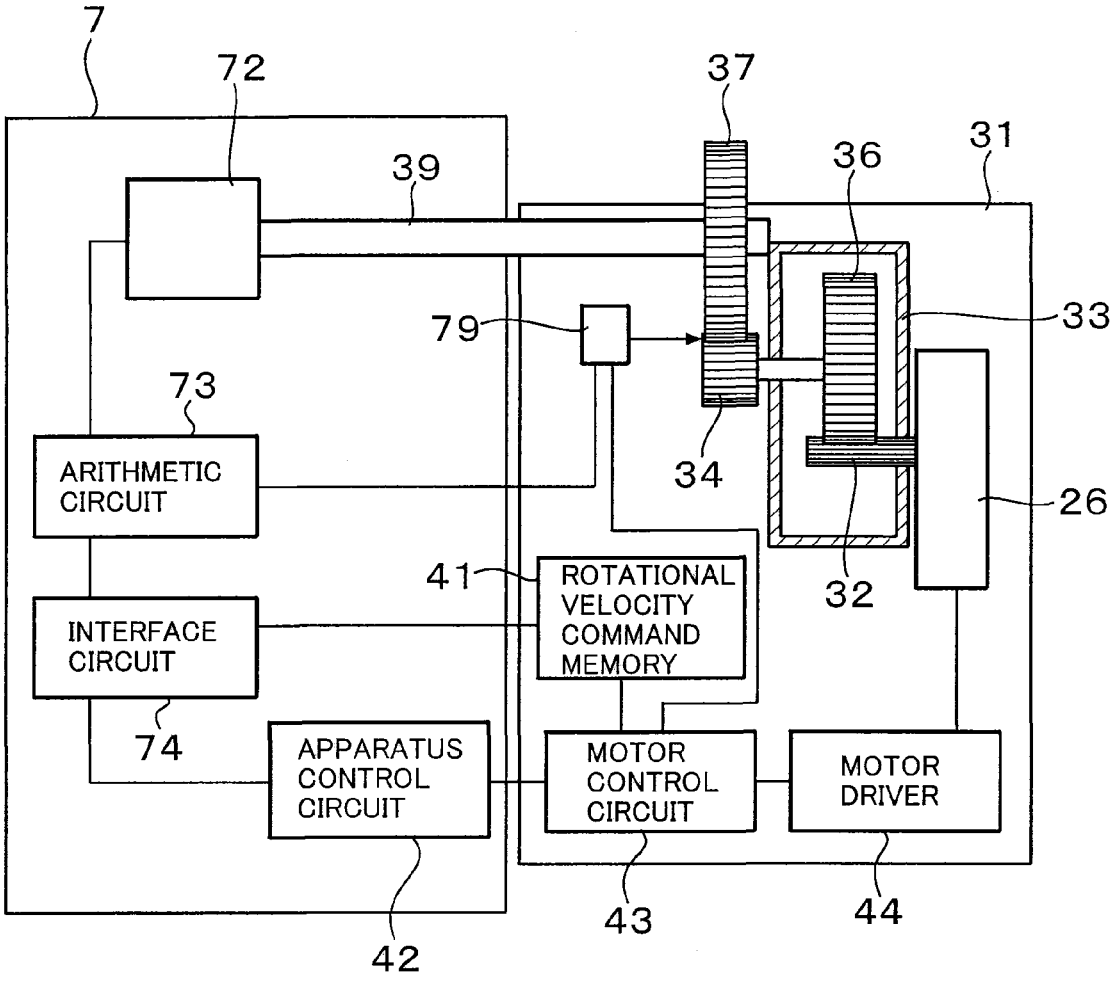
FIG. 5 is a schematic configuration diagram of a photoconductor driving unit and a velocity correction device in an image forming apparatus according to a third embodiment of the present invention.

FIG. 5 is a schematic configuration diagram of a photoconductor driving unit and a velocity correction device according to a third embodiment of the present invention.

As shown in FIG. 5, a photoconductor driving unit 31 is constituted by a motor 26, a motor gear 32, a gear A 36 serving as a reducer, a gear B 34 rotating coaxially with the gear A 36, a gear box 33, a motor control circuit 43, a motor driver 44 and a rotational velocity command memory 41.

A velocity correction unit 7 is constituted by a sensing gear 37 which can engage with the gear B 34 of the photoconductor driving unit 31, a transfer shaft 39 which connects the sensing gear 37 with an encoder 72, an apparatus control circuit 42, an arithmetic circuit 73, a gear one-turn sensor 79, and an interface circuit 74 through which command signals and motor rotational velocity command data can be transmitted to the motor control circuit 43.

A gear with higher precision than that of the joint gear 35 of the photoconductor drum 54 of the image forming apparatus 1 shown in FIG. 1 is used as the sensing gear 37 in order to prevent influence of fluctuation of the gear itself. The photoconductor driving unit 31 is connected to the velocity correction device 7 through the sensing gear 37.

The motor 26 rotates in response to a command signal from the apparatus control circuit 42. The rotational velocity of the sensing gear 37 caused by the rotation of the motor 26 is measured by the encoder 72. The gear one-turn sensor 79 is provided to face an end surface of the gear B 34 engaging with the sensing gear 37.

The output of the encoder 72 is processed into motor rotational velocity command data by the arithmetic circuit 73. The motor rotational velocity command data are data which can reduce the rotational velocity fluctuation of the gear B 34. The motor rotational velocity command data are supplied to the rotational velocity memory 41 through the interface circuit 74 and stored therein. The motor rotational velocity command data are built as data corresponding to one turn of the gear B 34 on the basis of a signal from the gear one-turn sensor 79.

The photoconductor driving unit 31 arranged thus is mounted on a body of the image forming apparatus 1. During the printing operation of the image forming apparatus 1, the motor 26 rotates in accordance with the motor rotational velocity command data in the rotational velocity command memory 41 so as to reduce the rotational fluctuation of the gear B 34. Thus, it is possible to reduce the rotational fluctuation caused by eccentricities, single pitch errors, cumulative pitch errors, etc. of the motor gear 32, the gear A 36 and the gear B 34.

An encoder for correcting the photoconductor velocity does not have to be provided in the body of the image forming apparatus 1. It is therefore possible to miniaturize the apparatus and reduce the cost.

In the aforementioned embodiment, the rotational velocity of a rotor such as a photoconductor drum was measured. However, the peripheral velocity of the rotor may be measured.

What is claimed is:

1. A velocity correction device attached removably to an image forming apparatus including a rotor, a motor for driving the rotor, a motor control unit for controlling an operation of the motor, and a velocity command memory for storing velocity command data and supplying the motor control unit with a command signal based on the velocity command data, wherein the image forming apparatus does not include a velocity measuring unit for correcting a rotational velocity of the rotor, the velocity correction device comprising:

a velocity measuring unit for measuring a rotational velocity or a peripheral velocity of the rotor of the image forming apparatus;

an arithmetic unit; and an interface unit for supplying the velocity command data to the velocity command memory of the image forming apparatus; wherein:

the velocity correction device is attached to the image forming apparatus in a manufacturing process of the image forming apparatus or in a replacement process of a unit in which the rotor is mounted so that the rotational velocity or the peripheral velocity of the rotor is measurable by the velocity measuring unit of the velocity correction device;

the interface unit of the velocity correction device is connected to the velocity command memory of the image forming apparatus;

the velocity measuring unit measures the rotational velocity or the peripheral velocity of the rotor when the motor is rotating at a reference rotational velocity which is a fixed velocity;

the arithmetic unit compares the measured velocity with a no-velocity-fluctuation velocity of the rotor calculated by the reference rotational velocity of the motor, extracts a velocity fluctuation component of the rotor, and generates the velocity command data to cancel the extracted velocity fluctuation component;

the velocity command data generated by the arithmetic unit are transmitted to the velocity command memory through the interface unit and stored in the velocity command memory, and the velocity correction device is removed from the image forming apparatus after storing the velocity command data.

2. A velocity correction device in the image forming apparatus according to claim 1, wherein the rotor includes at least one of a photoconductor drum, a photoconductor belt, a gear of a reducer for reducing a driving force from the motor, an intermediate transfer belt, and a roller for driving the photoconductor belt or the intermediate transfer belt.

3. A velocity correction device in the image forming apparatus according to claim 2, further comprising:

a one-turn sensor for detecting one turn of the rotor or the motor, wherein:

the arithmetic unit generates the velocity command data corresponding to the one turn of the rotor or the motor based on a detection signal of the one-turn sensor.

4. A velocity correction device in the image forming apparatus according to claim 3, further comprising:

a reduction gear provided between the motor and the rotor which will be measured by the velocity measuring unit, wherein:

a ratio of a rotation frequency with which the rotor rotates to a rotation frequency with which the reduction gear rotates is expressed by an integer.

5. A velocity correction device in the image forming apparatus according to claim 1, wherein the arithmetic unit includes a band pass filter for removing a fluctuation of a frequency component not higher than a rotation frequency of the rotor and a high frequency component that is difficult to recognize visually on any image formed by the image forming apparatus.

6. A velocity correction device in the image forming apparatus according to claim 1, further comprising:

a one-turn sensor for detecting one turn of the rotor or the motor, wherein:

the arithmetic unit generates the velocity command data corresponding to the one turn of the rotor or the motor based on a detection signal of the one-turn sensor.

7. A velocity correction device in the image forming apparatus according to claim 6, wherein time of the one turn detected by the one-turn sensor is divided into a plurality of split times, and the velocity command data are stored in the velocity command memory every split time.

8. A velocity correction device in the image forming apparatus according to claim 7, further comprising:

a reduction gear provided between the motor and the rotor which will be measured by the velocity measuring unit, wherein:

a ratio of a rotation frequency with which the rotor rotates to a rotation frequency with which the reduction gear rotates is expressed by an integer.

9. A velocity correction device in the image forming apparatus according to claim 6 further, comprising:

a reduction gear provided between the motor and the rotor which will be measured by the velocity measuring unit, wherein:

a ratio of a rotation frequency with which the rotor rotates to a rotation frequency with which the reduction gear rotates is expressed by an integer.

10. A velocity correction device in the image forming apparatus according to claim 1, further comprising:

a reduction gear provided between the motor and the rotor which will be measured by the velocity measuring unit, wherein:

a ratio of a rotation frequency with which the rotor rotates to a rotation frequency with which the reduction gear rotates is expressed by an integer.

11. A velocity correction method in an image forming apparatus including a rotor, a motor for driving the rotor, a motor control unit for controlling an operation of the motor, and a velocity command memory for storing velocity command data and supplying the motor control unit with a command signal based on the velocity command data, wherein the image forming apparatus does not include a velocity measuring unit for correcting a rotational velocity of the rotor, the velocity correction method comprising the steps of:

preparing a velocity correction device including a velocity measuring unit for measuring a rotational velocity or a peripheral velocity of the rotor of the image forming apparatus, an arithmetic unit, and an interface unit for supplying the velocity command data to the velocity command memory of the image forming apparatus;

attaching the velocity correction device to the image forming apparatus in a manufacturing process of the image forming apparatus or in a replacement process of a unit in which the rotor is mounted so that the rotational velocity or peripheral velocity of the rotor is measurable by the velocity measuring unit of the velocity correction device;

connecting the interface unit of the velocity correction device to the velocity command memory of the image forming apparatus;

rotating the motor of the image forming apparatus at a reference rotational velocity which is a fixed velocity, making the velocity measuring unit measure the rotational velocity or the peripheral velocity of the rotor when the motor is rotating at the reference rotational velocity, and supplying the measured velocity to the arithmetic unit;

making the arithmetic unit compare the measured velocity with a no-velocity-fluctuation velocity of the rotor calculated by the reference rotational velocity of the motor, extract a velocity fluctuation component of the rotor, and generate the velocity command data to cancel the extracted velocity fluctuation component;

transmitting the generated velocity command data to the velocity command memory of the image forming apparatus through the interface unit, and storing the velocity command data in the velocity command memory;

removing the velocity correction unit from the image forming apparatus after storing the velocity command data; and when the image forming apparatus which is delivered without the velocity correction device is operated by a user, reading the stored velocity command data from the velocity command memory, and supplying the velocity command data to the motor control unit so that the motor can perform the operation.

12. A velocity correction method in the image forming apparatus according to claim 11, wherein the rotor includes at least one of a photoconductor drum, a photoconductor belt, a gear of a reducer for reducing a driving force from the motor, an intermediate transfer belt, and a roller for driving the photoconductor belt or the intermediate transfer belt.

13. A velocity correction method in the image forming apparatus according to claim 12, wherein a one-turn sensor for detecting one turn of the rotor or the motor is provided, and the arithmetic unit generates the velocity command data corresponding to the one turn of the rotor or the motor based on a detection signal of the one-turn sensor.

14. A velocity correction method in the image forming apparatus according to claim 13, wherein time of the one turn detected by the one-turn sensor is divided into a plurality of split times, and the velocity command data are stored in the velocity command memory every split time.

15. A velocity correction method in the image forming apparatus according to claim 11, wherein the arithmetic unit includes a band pass filter for removing a fluctuation of a frequency component not higher than a rotation frequency of the rotor and a high frequency component that is difficult to recognize visually on any image formed by the image forming apparatus.

16. A velocity correction method in the image forming apparatus according to claim 11, wherein a one-turn sensor for detecting one turn of the rotor or the motor is provided, and the arithmetic unit generates the velocity command data corresponding to the one turn of the rotor or the motor based on a detection signal of the one-turn sensor.

17. A velocity correction method in the image forming apparatus according to claim 16, wherein time of the one turn detected by the one-turn sensor is divided into a plurality of split times, and the velocity command data are stored in the velocity command memory every split time.

18. A velocity correction method in the image forming apparatus according to claim 17, wherein a reduction gear is provided between the motor and the rotor which will be measured by the velocity measuring unit, and a ratio of a rotation frequency with which the rotor rotates to a rotation frequency with which the reduction gear rotates is expressed by an integer.

19. A velocity correction method in the image forming apparatus according to claim 16, wherein a reduction gear is provided between the motor and the rotor which will be measured by the velocity measuring unit, and a ratio of a rotation frequency with which the rotor rotates to a rotation frequency with which the reduction gear rotates is expressed by an integer.

20. A velocity correction method in the image forming apparatus according to claim 11, wherein a reduction gear is provided between the motor and the rotor which will be measured by the velocity measuring unit, and a ratio of a rotation frequency with which the rotor rotates to a rotation frequency with which the reduction gear rotates is expressed by an integer.

* * * * *